US005411560A

United States Patent [19]

Mainwaring et al.

[11] Patent Number: 5,411,560

[45] Date of Patent: May 2, 1995

[54] METHOD OF PRODUCING BINDERLESS PELLETS FROM LOW RANK COAL

[75] Inventors: David E. Mainwaring; David W. Guy, both of Hawthorn, Australia

[73] Assignee: Swinburne Limited, Australia

[21] Appl. No.: 145,623

[22] Filed: Nov. 4, 1993

[30] Foreign Application Priority Data

Nov. 5, 1992 [AU] Australia ..... PL5701

[51] Int. Cl.[6] ..... C10L 5/00

[52] U.S. Cl. ..... 44/592; 44/593; 44/608; 264/29.3

[58] Field of Search ..... 44/592, 593, 608, 629, 44/550, 634; 264/29.3

[56] References Cited

U.S. PATENT DOCUMENTS 4,410,472 10/1983 Grubbs et al. ..... 264/29.3

4,701,184 10/1987 Harvey et al. ..... 44/592 X

*Primary Examiner*—Prince Willis, Jr.

*Assistant Examiner*—Cephia D. Toomer

*Attorney, Agent, or Firm*—Burns, Doane, Swecker & Mathis

[57] ABSTRACT

The invention relates to a method and apparatus of forming pellets and in particular spherical binderless pellets from lower rank coals. The method includes the steps of feeding a pelletizing means 10, with a lower rank feedstock, 1; rotating the coal in said pelletizing means, 10, to form pellets in the absence of any binder, wherein the pellets are formed by compaction and layering of coal fines. The moisture content of the lower rank coal is at a level so as to at least substantially fill the voids within the coal.

6 Claims, 2 Drawing Sheets

METHOD OF PRODUCING BINDERLESS PELLETS FROM LOW RANK COAL

The invention relates to a method of forming pellets and in particular spherical binderless pellets from lower rank coals.

Lower rank coals are generally regarded as a low quality fuel source. This view has largely resulted from a consideration of the high water content of the lower rank coals and the difficulties associated with handling of fine material. On average, lower rank coals in their pure form contain up to about 60% moisture content by weight, which results in a substantial percentage of the energy derived from the coal being used to dry the lower rank coal fuel prior to combustion. From the handling point of view, dried lower rank coals, due to their softness, breakdown and produce a higher than normal volume of fines. This makes handling of the pure lower rank coals extremely difficult and also hazardous. With the high volume of fines produced, and their associated large surface area there is an increased propensity to spontaneously combust.

Despite the disadvantages of the lower rank coals, the lower rank coals also provide significant advantages to industry, some may have low ash content, low nitrogen levels and high reactivity while most have lower mining costs. However, to exploit the advantages industrially, both moisture content and the handling characteristics must be addressed.

Briquetting has been one way of addressing the problems associated with utilising lower rank coals. However, the briquetting process is both time consuming but more importantly energy consuming. The lower rank coal must first be made into a homogeneous form such that the briquettes are then stamped from the homogeneous mass. In order for the briquettes to be made, the coal must be dried using additional energy.

In addition to briquetting, pelletisation of the lower rank coals has been attempted. Pelletisation of lower rank coals has been attempted using the known technique of slurry phase agglomeration which is carried out in a dilute water slurry and in combination with an immiscible bridging oil. This process forms spherical agglomerates and relies totally on the surface of the coal fines being preferentially wetted by the bridging oil. Considerable development work has been carried out in relation to this slurry phase agglomeration process, however, because of the low coal values, the characteristics of the lower rank coals and the cost of the oil binder, the slurry phase agglomeration method is not cost effective when compared to the briquetting technique for lower rank coals. In fact, based upon trials conducted by the inventors, slurry phase agglomeration was not possible on the Australian lower rank coals trialled.

Therefore, the object of the invention is to at least address some of the problems of the prior art and to more efficiently make use of the lower rank coals which are prevalent in Australia and throughout the World.

The invention provides a method of forming binderless pellets from lower rank coals including the steps of (a) feeding a pelletising means with a lower rank coal feedstock;

(b) rotating the coal in said pelletising means to form pellets in the absence of any binder;

wherein said pellets are formed by compaction and layering of coal fines.

Advantageously, the present invention provides an energy and cost efficient way of utilising lower rank coals and forming the generally-difficult to handle lower rank coals, into an easy to handle material which has been found to be in equivalent strength and moisture content to briquettes and less likely to spontaneously combust.

The present invention is predicated upon the discovery that only coals with particular characteristics can form pellets using the prior art slurry phase agglomeration technique which utilises immiscible bridging oils as binders. In particular, only coals with high hydrophobicity, low oxygen content and high strength can be pelletised using the known slurry phase oil agglomeration technique. The type of coals with the above characteristics are regarded as "high rank" coals, which because of their hydrophobicity are preferentially wetted by the bridging oil resulting in agglomeration of the coal particles. The strength of the oil agglomeration pellets is limited to that of the bonding liquid or low levels of mechanical interlocking that may occur.

Thus, it has become apparent that the characteristics of lower rank coals of being hydrophilic, low structural strength and high oxygen content are generally undesirable and ineffective for use in the prior art slurry phase agglomeration techniques such as oil agglomeration.

However, it has subsequently been discovered that binderless pellets can be formed from lower rank coals utilising their normally undesirable characteristics thereof. Generally, a "lower rank coal" is regarded as having a surface carbon to oxygen ratio of less than 10, preferably less than 7 and more preferably less than 5. A high carbon content is generally associated with having high hydrophobic sites and a high oxygen content is generally associated with primarily hydrophilic sites.

The rotating of the feedstock leads to further crushing of the lower rank coal into fines. Seed pellets form from the coal fines as a result of the rotating action of the pelletising means. Once the pellet reaches a certain mass, a "gel layer" forms on the outside of the pellet. The "gel layer" is continuously present in the growth phase of the pellet and its presence is essential to the growth of the pellet. In the "gel layer" the coal and water are homogeneous. Additionally, the rotating and tumbling action advantageously assists in the compaction of the pellets.

In order to form seed pellets and maintain the "gel layer" in the growth phase, the moisture content of the coal bed must be at a level so as to at least substantially fill the voids within the coal.

Thus the moisture content of the bed is dependent upon the porosity of the coal. Additional water may be required to be added to the coal bed, if for example the coal has been allowed to dry slightly prior to pelletisation; however, generally, as-mined brown coal contains sufficient moisture to form seed pellets and form and maintain the necessary gel layer. Of course depending upon where the coal is sourced, the moisture content varies; however, as a guide Loy Yang (Victorian, Australian) as-mined coal contains 60 wt % (wet basis) moisture.

The present invention does not require the large quantities of water that the prior art slurry process required and in fact, the process of the present invention is considered to be a "dry" pelletisation process.

In large scale industrial operations in order to produce the pellets in a commercially acceptable time, the pellets may require additional drying. It should be noted that this additional step is only a drying step and is not a reaction step at high temperature to increase strength.

The invention also provides an apparatus for forming binderless pellets from lower rank coals including:

(a) pelletising means; and (b) means to feed the lower rank coal feedstock into (a)

wherein coal feedstock is able to be formed into pellets as a result of compaction and layering of the coal fines.

Preferably the pelletising means is a rotary acting pelletiser and can be of any type. However, it is preferable to use the drum type of pelletiser, which enables tumbling and rotating of the feedstock.

The nature of the invention will be better understood with reference to the following preferred embodiment and examples.

The method of the present invention uses a similar feedstock of lower rank coal as is used in the briquetting process. Briquette feedstock generally has been partially ground and has, as a guide, the following characteristics: Moisture content is "as-mined" content for the lower rank coal, for example Loy Yang coal has approximately 60 wt % (wet basis), but other coals, depending upon the source have slightly different "as-mined" moisture contents.

The top size of the feed is preferably less than or equal to 8.00 mm, but any top size less than 8.00 mm can be pelletised.

A "lower rank coal", as indicated previously, is regarded as having a surface to carbon to oxygen ratio of less than 10, preferably less than 7 and more preferably less than 5. The binderless pelletisation procedure can be used with all Victorian (Australian) brown coal types and is applicable to all coals possessing a similar rank.

Figure 1:
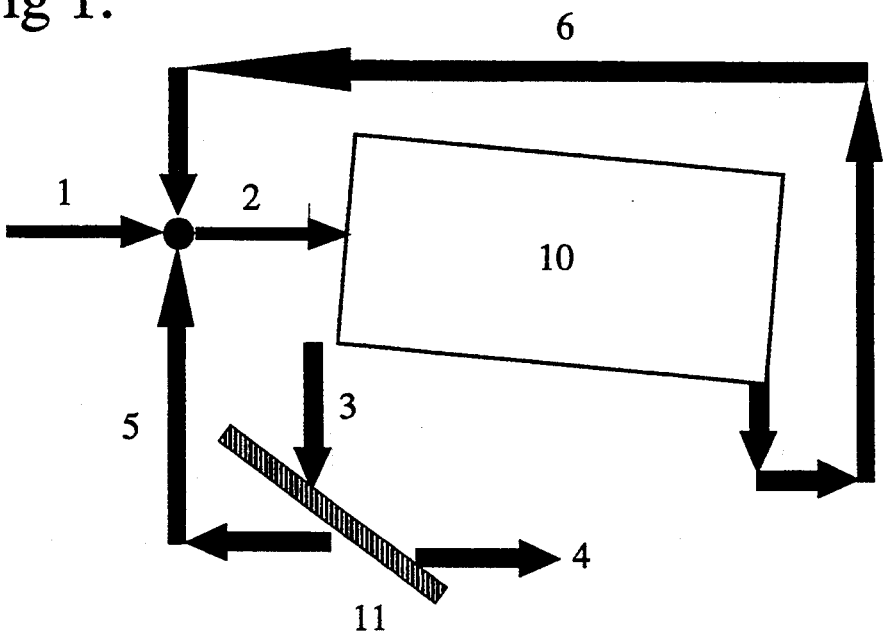
FIG. 1 illustrates a schematic representation of the pelletising process.

With reference to FIG. 1, the lower rank coal is fed into the rotary pelletising means 10, and can enter the pelletising means at any position in the pelletiser by means of a moveable feed system (not shown). By allowing the feed system to be moveable, this allows control of the growth rate of the pellets and the rate of feed pellet production. If the feed system is stationary, too many seed pellets may form, thus inhibiting the growth of pellets to the desired size.

The pelletising means 10 is preferably a rotating pelletising means of any type (such as drum or disc type), but is more preferably of the drum type. A drum-type pelletiser enables the coal mass to tumble and cascade and thus in the initial stages further grinding the feed coal down to powder or fines occurs. The same tumbling and cascading action provides the required compaction to assist in the formation of the initial seed pellets but also compression of the material to aid in the growth of the pellets.

The feedstock of lower rank coal is fed (stream 1) into the pelletising apparatus and is allowed to rotate and tumble, the tumbling action breaks down the feedstock down into fines. Gradually seed pellets begin to form from the fines which compact and bond together. The pellet forming process continues by the formation of a "gel layer" on the outside of the pellet. As the tumbling action continues the core of the pellet is compressed squeezing out water which results in compaction and densification of the pellet. However, in the growing phase on the outside of the pellet there is the "gel layer" which makes use of the water being squeezed out of the core. The squeezed out water mixes with further coal fines to form a homogeneous mass of coal and water which signifies the "gel layer". Thus, in order for the pellet to grow the "gel layer" must be present. In the gel layer compared to elsewhere in the pellet, the moisture of the coal is greater than in the core of the pellets. The pellet is progressively built up by the layering and compaction processes. The degree of compaction in the "wet" pellet stage generally increases with increasing bed size.

In order to form the "gel layer", it is essential that there be sufficient moisture to produce the homogenous mass of coal and water on the outer surface of the growing pellets when subjected to compaction and shear. As indicated previously, the moisture content of the coal must be at a level so as to at least substantially fill the voids within the coal. Generally, the as-mined Victorian (Australian) brown coal contains sufficient moisture to form the gel layer under the conditions of shear imparted by the tumbling and cascading motion of the bed of coal material. However, in some cases, such as where the coal feed has been allowed to dry out prior to the pelletisation process, additional water may be required. Generally, if water is added it is preferably sprayed into the pelletiser.

Pelletisation occurs at normal temperatures and humidities, typically ranging from 10° C. to 35° C. and relative humidities of between 20% and 80%.

The dimensions of the pelletiser are dependent upon the output required and thus similarly the mass of coal in the pelletiser at any time is generally equal to one third of the volume of the pelletiser. This will allow sufficient tumbling and cascading to form the seed pellets and obtain growth thereof.

By way of example, the pilot plant has a pelletiser with a volume of 960 L with an anticipated production rate of 100 kg/hour. The drum dimensions are 1220 mm length $\times$1000 mm diameter and is driven by a 550 Watt (0.75 hp) motor gear box combination at between 3.2 and 16 rpm. The mass of the coal material in the pelletiser will be approximately 320 L (450 kg).

The output, 3, from the pelletising means, 10, is preferably screened, 11, to size wherein the pellets of the desired size, 4, are separated from the undersized, 5. It should be noted that the final pellet size depends upon customer requirements.

Similarly, fine coal, 6, can be recycled to the pelletiser 10.

The recycled material (streams 5 and 6) can be combined with the feed 1, or can be fed in separately at different locations. Generally, the recycled material (streams 5 and 6) can be equivalent to between 100 and 200 weight % of the bed mass. As with the moveable feed system to the pelletiser, (not shown) by recycling the bed material this assists in controlling the growth rate of pellets and the formation of seed pellets.

Based upon the pilot plant, once the pelletising system reaches a steady state, at a production rate of approximately 100 kg/hour, the residence time in the pelletiser will be in the order of 1½ hours to 5½ hours per 100 kg of coal depending upon the recycle rate.

The process of the present invention can act as a batch, continuous or semi-continuous process. The process is preferably continuous, to allow greater production rates.

The so-called "wet" pellets resulting from the process of the present invention, without allowing them to dry, have good strength and can be easily handled. The "wet pellets" generally have a moisture content approximately equal to moisture content during the growth phase which is generally the "as-mined" moisture content. In the case of Loy Yang (Victorian, Australian) coal the moisture content is 60 wt % (wet basis). The strength of the "wet pellets" is approximately $1\times10^5$ kg $m^{-2}$. The pellets are uniform in composition and have low porosity. When compared to the high rank coal counterparts produced by the slurry method, at the "wet" stage", the "wet" pellets of the present invention are much stronger. This is generally due to the compaction of the pellets.

It is not essential that the pellets of the present invention be heated in order for the strength to be increased to the desired level. If the pellets are left to dry naturally, the resulting crushing strength of the pellets is comparable to briquettes. After drying the moisture content of the pellets is approximately 12–15 wt % (wet basis), with a strength of approximately $6\times10^5$ kg $m^{-2}$. The strength of briquettes is approximately $16\times10^5$ kg $m^{-2}$. However, as previously indicated, some additional drying may be necessary to dry the pellets in a commercially acceptable time frame. The drying of pellets to approximately 35 wt % (wet basis) moisture can be carried out in about 30–40 minutes in a fluidised bed drier. The removal of the remaining moisture (down to the equilibrium moisture content of 15 wt %) is most preferably carried out at a relatively slower rate, approximately 2 hours. On drying, the "wet" pellets of the present invention shrink, resulting in further compaction of the coal within the pellet.

The coal product may be sold at any moisture content depending on the customer requirements and the associated transportation costs.

EXAMPLE 1

A pelletising drum driven by a direct drive variable speed gearbox motor configuration, which allows changes to be made in the rotational speed of the arm as the circulating bed mass changes, was operated in a continuous fashion. The volume of the pilot scale pelletising drum was 240 L, capable of pelletising a volume of 80 L. Raw brown (low rank) coal fines (−8 mm) were fed into the pelletising drum at the rate of 5 kg/hour and during the first two hours 300 g of water was added during this time. After this stage no further water was added to the drum during the entire pelletising process.

Seed pellets appeared instantaneously and the rate of coal addition was increased to an average of more than 16 kg/hour. The maximum rate was 20 kg/hour.

Pellets grew in the drum via a mechanism of continuous layering of fine material onto the surface of pellets, no additions of water were required to achieve growth. Increased rotating bed mass caused continuous compression of the internal pores of the pellets and hence expulsion of water to the surface of the pellets. The final product, with a top size of 25 mm, was collected from the front of the drum. During continuous operation the rate of pellet production matched the rate of fine coal addition.

The pellets were air dried at ambient, 25° C., conditions resulting in pellets with an equilibrium moisture content of approximately 12 wt % (wet basis).

Pellet characteristics

Pellet size distribution

The following table shows the size distribution of the pellets produced in Example 1.

TABLE 1

| SCREEN SIZE (mm) | WEIGHT OF PELLETS ON SCREEN (g) | WEIGHT % OF TOTAL | CUMULATIVE % OVERSIZE |
|---|---|---|---|
| 19.2 | 1999 | 36.4 | 36.4 |
| 13.2 | 1652 | 30.1 | 66.5 |
| 11.2 | 1834 | 33.4 | 100.0 |
| −11.2 | — | | |
| TOTAL | 5485 | | |

The pellet top size was 25 mm.

Effect on pellet porosity

Coal samples for porosity measurements were prepared by air drying the coal to equilibrium moisture content then, in the case of coal pellets splitting the pellet in half and dividing the sample into an inner section and an outer section. The samples were then reduced to zero moisture in a vacuum oven prior to measurements of porosity being taken.

The pore size distribution of each of the outside and inside sections of the pellet, were very similar to each other indicating that the pore distribution throughout the pellet was fairly uniform. The reason for the consistency of the pore distribution is the impact of high compressive forces on the pellet. Additionally, it was observed that the average pore size is increased as a result of pelletisation, thus resulting in a reduction in porosity and hence an increase in density. A summary of these findings is as follows:

TABLE 2

| RESULT | RAW BROWN COAL | PELLET (OUTER) |
|---|---|---|
| BULK DENSITY (g $cm^{-3}$) | 0.76 | 0.86 |
| PORES >10 μm ($cm^3$g-1 | 0.148 | 0.049 |
| MEDIAN PORE DIAMETER (μm) | 1.334 | 0.422 |
| AVERAGE PORE DIAMETER (μm) | 0.284 | 0.117 |

Pellet strength

Figure 2:
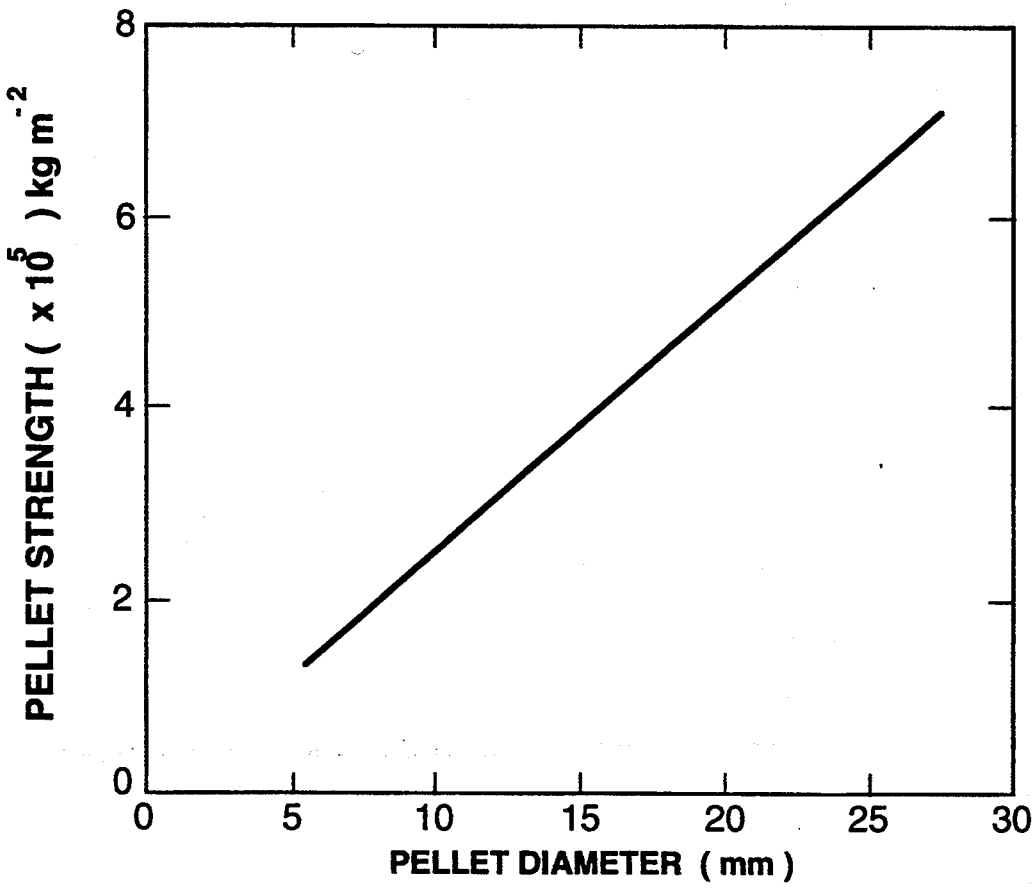
FIG. 2 illustrates a plot of pellet strength vs. pellet diameter of the pellets produced by a preferred embodiment of the process of the present invention and discussed in Example 1.

The strength of pellets produced in the example were assessed by measuring the compressive strength of the pellets. FIG. 2 illustrates the results obtained for a distribution of pellets removed from the circulating bed. Pellets of 25 mm in diameter possess a strength of $6.9\times10^5$ kg $m^{-2}$, compared to briquettes which have an average compressive strength of $16\times10^5$ kg $m^{-2}$.

Packing density

The packing density of the pellets produced in the example was approximately 480 kg $m^{-3}$.

Therma stability

Since spontaneous combustion is one of the major problems associated with utilisation of lower rank coal fines it was necessary to consider and compare the reactivity of the binderless pellets towards the oxidation process. The Differential Thermal Analysis (DTA) technique. The process requires heating 10 mg of a −106+53 μm fraction of air dried coal in the presence of air firstly to 110° C. for 15 minutes to remove water and then at a rate of 10° C./min up to 700° C.

Figure 3:
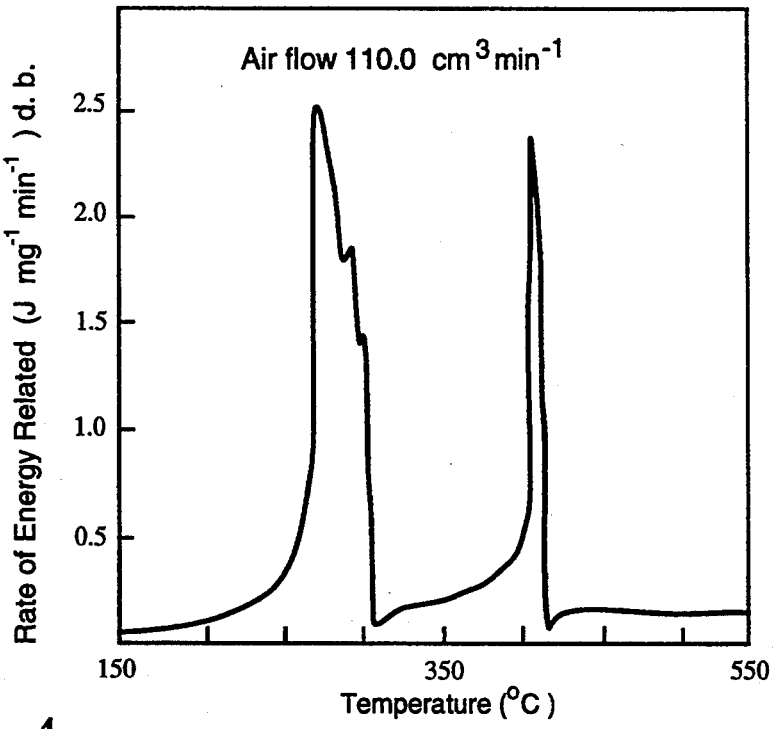
FIG. 3 illustrates a thermal profile of Loy Yang (Victorian, Australian) lower rank coal fines at an air flow ratio of 110.0 $cm^3$/min.

FIG. 3 illustrates a thermal profile of Loy Yang (Victorian, Australian) lower rank coal fines at a relatively high flow rate of air of 110.0 $cm^3$/min. Two peaks are observed at this flow rate, one at 300° C. which is unique to low rank coals and a second at about 400° C. which is common to coals of all rank.

Figure 4:
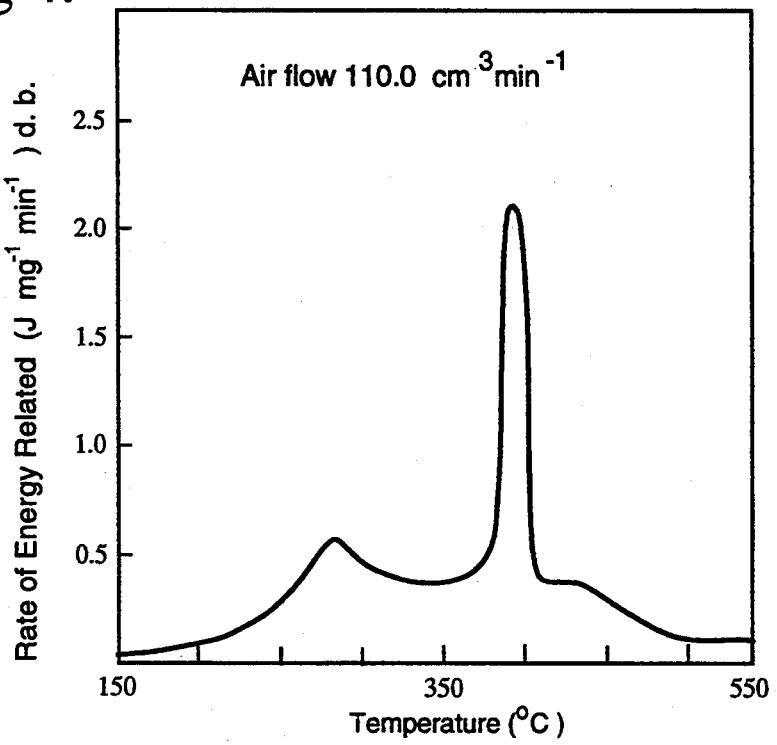
FIG. 4 illustrates a thermal profile of a pellet produced by the method of the present invention at an air flow rate of 110.0 $cm^3$/min.

A flow rate of 110.0 $cm^3$/min was adopted to study the effect of pelletisation on the oxidation profile of the brown coal fines. FIG. 4 shows the profile of a pellet produced by the method of the present invention. It can be seen that the pelletisation process significantly reduces the area of the exothermic peak occurring at 300° C. as compared to that of the peak occurring for raw brown coal fines. The reduction in the peak area represents a decrease in the susceptibility of the coal fines to low temperature oxidation—spontaneous combustion.

EXAMPLE 2-COMPARATIVE EXAMPLE

To ascertain the impact of binder on the formation and strength of brown coal pellets produced by the process of the present invention, experiments were conducted forming pellets using binders such as sodium carbonate, starch, brown coal, humic acid and ammonium hydroxide. It should be noted that the process used in this example was not the prior art slurry phase agglomeration process which utilised oil binders. The binding agents were selected to span conventional binders used in mineral pelletisation and binders which would appreciably alter the pH of the final coal—water mixture—"the gel layer".

TABLE 3

CONCENTRATION OF BINDER USED

| Binding Agent | Final % of binding agent in pellets (by wt on a dry coal basis) |
|---|---|
| Wheat starch | 2.5 |
| $Na_2CO_3$ | 2.5 |
| Brown Coal Humic Acid | 2.5 |
| $NH_4OH$ | 0.38 |

PELLETISATION KINETICS

The pelletisation process was assessed using an 11 liter rotating drum. An initial charge of 50 g of −5.6+4.75 mm material was introduced to the drum as the seed pellets. To this was added coal fines (crushed to −6 mm), at an average rate of 32 g/min, spray water and binding agent. A total of 1650 g of coal fines were added in each case and the final pellet size distribution used to assess the effect of the binding agent on the pelletisation kinetics. Periodically during the pelletisation process fine material in the −4.75 mm size range (not considered as pellets) was removed so that the predominant mechanism studied here was pseudo-continuous pellet (gel layer) growth and not seed pellet formation. This procedure ensures that the system does not become 'choked' with seed pellets (−4.75 mm material) which hinders the growth mechanism of the already existing pellets.

The binders were added to the system in one of two ways:

(i) in the form of a solid along with the coal fines in the ratio of 1:100, binder:fines by weight;

(ii) along with the spray water as a 10% solution, in the case of brown coal humic acid and as a 3.3% solution in the case of $NH_4OH$.

The final pellet size distributions are shown in Tables 4 to 7. When these pellet size distributions are compared to binderless brown coal pellets produced in a similar manner and shown in Table 8, it can be seen that the addition of low levels of binding agents during the pelletisation of fine brown coal has either little effect on the production of the coal pellets, as in the case of brown coal humic acid, or an adverse effect on pellet production, as with the other binding agents (wheat starch, $Na_2CO_3$, $NH_4OH$).

TABLE 4

PELLET SIZE DISTRIBUTION FOR PELLETS CONTAINING WHEAT STARCH

| Screen Size (mm) | Weight of Pellets on Screen (g) | Number of Pellets | Fraction by number finer |
|---|---|---|---|
| +25.0 | — | — | 1.00 |
| +19.0 | — | — | 1.00 |
| +13.2 | 445.3 | 283 | 0.71 |
| +11.2 | 435.8 | 378 | 0.33 |
| +8.0 | 134.2 | 219 | 0.11 |
| +6.7 | 18.6 | 71 | 0.04 |
| +5.6 | 8.7 | 38 | 0.00 |
| +4.75 | 0.3 | 3 | 0.00 |

TABLE 5

PELLET SIZE DISTRIBUTION OF PELLETS CONTAINING $Na_2CO_3$

| Screen Size (mm) | Weight of Pellets on Screen (g) | Number of Pellets | Fraction by number finer |
|---|---|---|---|
| +25.0 | — | — | 1.00 |
| +19.0 | 142.8 | 29 | 0.97 |
| +13.2 | 455.1 | 197 | 0.74 |
| +11.2 | 255.1 | 240 | 0.47 |
| +8.0 | 230.4 | 395 | 0.29 |
| +6.7 | 2.1 | 8 | 0.01 |
| +5.6 | 0.71 | 4 | 0.00 |
| +4.75 | 0.0 | 0 | 0.00 |

TABLE 6

PELLET SIZE DISTRIBUTION OF PELLETS CONTAINING BROWN COAL HUMIC ACID

| Screen Size (mm) | Weight of Pellets on Screen (g) | Number of Pellets | Fraction by number finer |
|---|---|---|---|
| +25.0 | — | — | 1.00 |
| +19.0 | — | — | 1.00 |
| +13.2 | 984.1 | 601 | 0.47 |
| +11.2 | 520.4 | 314 | 0.20 |
| +8.0 | 76.0 | 137 | 0.08 |
| +6.7 | 8.9 | 34 | 0.05 |
| +5.6 | 3.7 | 30 | 0.02 |
| +4.75 | 1.9 | 27 | 0.00 |

TABLE 7

PELLET SIZE DISTRIBUTION FOR PELLETS CONTAINING $NH_4OH$

| Screen Size (mm) | Weight of Pellets on Screen (g) | Number of Pellets | Fraction by number finer |
|---|---|---|---|
| +25.0 | — | — | 1.00 |
| +19.0 | — | — | 1.00 |
| +13.2 | 823.2 | 468 | 0.78 |
| +11.2 | 384.4 | 339 | 0.62 |
| +8.0 | 197.9 | 383 | 0.44 |
| +6.7 | 94.7 | 408 | 0.24 |
| +5.6 | 64.2 | 434 | 0.04 |
| +4.75 | 7.0 | 79 | 0.00 |

TABLE 8

PELLET SIZE DISTRIBUTION FOR BINDERLESS BROWN COAL PELLET

| Screen Size (mm) | Weight of Pellets on Screen (g) | Number of Pellets | Fraction by number finer |
|---|---|---|---|
| +25.0 | — | — | 1.0 |
| +19.0 | — | — | 1.00 |
| +13.2 | 1302.7 | 705 | 0.26 |
| +11.2 | 61.01 | 58 | 0.22 |
| +8.0 | 79.86 | 159 | 0.06 |
| +6.7 | 7.97 | 32 | 0.03 |
| +5.6 | 2.02 | 14 | 0.01 |
| +4.75 | 0.96 | 12 | 0.00 |

It can be seen in Table 9 that the amount of spray water required during the pelletisation process was almost halved when using $NH_4OH$ as the binder. This can be attributed to the fact that the pH of the 3.3% $NH_4OH$ spray solution was about 12, this high pH would cause solubilisation of humates on the surface of the pellet. This in turn would give the pellet surface an increased liquid content and hence the pellet would require less additional water to reach the moisture content required for pelletisation to occur.

TABLE 9

| Binding Agent | Water required during pelletisation process (g) |
|---|---|
| Nil | 164 |
| Wheat starch | 168 |
| $NH_4OH$ | 77 |
| $Na_2CO_3$ | 201 |
| Humic acid | 136 |

Pellet strength

Table 10 shows the crushing force required to break down coal pellets produced with or without the addition of binders and dried to an equilibrium moisture content at room temperature. The results show that there is only a slight increase in pellet strength on the addition of $NaCO_3$ and a negative effect with the remaining binding agents (wheat starch, $NH_4OH$, Humic acid).

TABLE 10

| Binding Agent | Force required to crush pellet ($Kg\ m^{-2}$) |
|---|---|
| Nil | $4.25 \times 10^5$ |
| Wheat starch | $5.7 \times 10^5$ |
| $NH_4OH$ | $4.0 \times 10^5$ |
| $Na_2CO_3$ | $3.8 \times 10^5$ |
| Humic acid | $2.7 \times 10^5$ |

Pellet porosity

It was observed that for pellets of similar sizes, the addition of binding agent had no significant effect on the porosity of pellets produced, in particular, no increase in the density of pellets was observed. However, the brown coal humic acid binder increased the porosity significantly when compared to the equivalent pellet porosity of the pellet without binder.

Summary of example

From this example, it appears that there is no substantial benefit to the addition of low levels of binding agent during the pelletisation process of the present invention. Although the addition of $Na_2CO_3$ slightly improved the crushing strength of the pellet, this was accompanied by a reduced rate of production of desirable larger pellets in the pelletisation drum.

The "dry" pellets of the present invention as are their "wet" pellet counterparts are uniform in composition and have low porosity. The pellets of the present invention in addition to the comparable crushing strength to briquettes, can have an equivalent (12–15% of the original moisture content) final moisture content to briquettes. The abrasion rates of the pellets of the present invention are lower than briquettes because the pellets are spherical. Furthermore, because of the variation in size and the shape of the pellets obtained, packing and handling of the pellets is advantageously improved. The compaction of the coal in the present pellets is higher than raw coal resulting in higher self-heating temperature thus resulting in less heat generated being used for heating the fuel feed. The higher compaction of the coal in the present pellets also results in less fines, which assists in the handling of the fuel and minimises, even more so than briquettes, the risk of spontaneous combustion. Furthermore, because the process can be operated on a continuous process and the plant required to produce the pellets of the present invention is relatively simple, much higher volumes of crushed feed, for equivalent costs, can be processed when compared to the conventional briquette factory.

We claim:

1. A method of forming binderless pellets from a low rank coal comprising the steps of:
   (a) providing a feedstock consisting of a low rank coal having a surface carbon to oxygen ratio of less than 10;
   (b) feeding said low rank coal to a rotory pelletizing station;
   (c) maintaining the moisture level in said coal so that the voids within the coal are filled; and
   (d) rotating the coal in the pelletizing station for a time sufficient to comminute the coal and form pellets in a growth phase without the addition of binders.

2. A method as claimed in claim 1, wherein the moisture content of the coal is maintained at a level which produces a gel layer on the coal surface during the growth phase of the pellets.

3. A method as claimed in claim 2, wherein water is added to the coal prior to or during pelletization.

4. A method as claimed in claim 2, wherein the size of the feedstock is 8 mm or less.

5. The method as claimed in claim 2, including the step of drying the pellets formed in step (d).

6. Binderless pellets formed from low rank coals, wherein the pellets are formed by a method comprising the steps of:
   (a) providing a feedstock consisting of a low rank coal having a surface carbon to oxygen ratio of less than 10;
   (b) feeding said low rank coal to a rotory pelletizing station;
   (c) maintaining the moisture level in said coal so that the voids within the coal are filled; and
   (d) rotating the coal in the pelletizing station for a time sufficient to comminute the coal and form pellets in a growth phase without the addition of binders;

wherein the moisture content of the coal is maintained at a level which produces a gel layer on the coal surface during the growth phase of the pellets.

* * * * *